US008261574B2

(12) United States Patent
Sato et al.

(10) Patent No.: US 8,261,574 B2
(45) Date of Patent: Sep. 11, 2012

(54) AIR CONDITIONING SYSTEM AND ACCUMULATOR THEREOF

(75) Inventors: Toshiyuki Sato, Nagoya (JP); Michihiko Yamamoto, Nagoya (JP)

(73) Assignee: Aisin Seiki Kabushiki Kaisha, Kariya-shi (JP)

( * ) Notice: Subject to any disclaimer, the term of this patent is extended or adjusted under 35 U.S.C. 154(b) by 638 days.

(21) Appl. No.: 12/396,032

(22) Filed: Mar. 2, 2009

(65) Prior Publication Data

US 2009/0229285 A1 Sep. 17, 2009

(30) Foreign Application Priority Data

Mar. 13, 2008 (JP) ..... 2008-064438

(51) Int. Cl.
*F25B 43/00* (2006.01)
*F25B 43/02* (2006.01)

(52) U.S. Cl. ..... 62/503; 62/471; 62/470

(58) Field of Classification Search ..... 62/149, 62/196.1, 470, 471, 503, 512
See application file for complete search history.

(56) References Cited

U.S. PATENT DOCUMENTS

2010/0005831 A1* 1/2010 Vaisman et al. ..... 62/470

FOREIGN PATENT DOCUMENTS

| | | |
|---|---|---|
| JP | 1-107071 | 4/1989 |
| JP | 4-222366 | 8/1992 |
| JP | 8-49930 | 2/1996 |
| JP | 8-296908 | 11/1996 |
| JP | 2000-193327 | 7/2000 |
| JP | 2002-106986 | 4/2002 |
| JP | 2006-038365 | 2/2006 |
| JP | 2006-322617 | 11/2006 |
| JP | 2008045777 A * | 2/2008 |

OTHER PUBLICATIONS

Office Action issued Jul. 10, 2012, in Japanese Patent Application No. 2008-064438, filed Mar. 13, 2008 (with English language translation).

* cited by examiner

*Primary Examiner* — Chen Wen Jiang
(74) *Attorney, Agent, or Firm* — Oblon, Spivak, McClelland, Maier & Neustadt, L.L.P.

(57) ABSTRACT

An air conditioning system having an outdoor heat exchanger and an indoor heat exchanger between which a refrigerant circulates to effect a heat exchange between the refrigerant and outdoor air at the outdoor heat-exchanger and to effect another heat exchange between the refrigerant and indoor air at the indoor heat exchanger, the air conditioning system which includes a compressor sucking the refrigerant to compress and discharging the resulting refrigerant, a liquid pump sucking the refrigerant to discharge, an expansion valve expanding the refrigerant, and an accumulator serving for gas-liquid separation of the refrigerant and accumulating the refrigerant in liquid phase, wherein when the compressor is brought into operation for indoor air cooling, the compressor, the outdoor heat exchanger, the expansion valve, the indoor heat exchanger, and the accumulator are connected in such an order to circulate the refrigerant therethrough, wherein suction lines of the respective compressor and liquid pump are in parallel to suck the refrigerant from the accumulator, and wherein when the compressor and the liquid pump are concurrently operated for indoor air cooling, a discharge line of the liquid pump is connected to the outdoor heat exchanger for discharging the refrigerant therefrom.

8 Claims, 7 Drawing Sheets

Compressor

Liquid pump + Compressor

Note: [Degree of dryness] = Gas mass flow rate / Total mass flow rate

AIR CONDITIONING SYSTEM AND ACCUMULATOR THEREOF

CROSS REFERENCE TO RELATED APPLICATIONS

This application is based on and claims priority under 35 U.S.C. §119 with respect to Japanese Patent Application 2008-064438, filed on Mar. 13, 2008, the entire content of which is incorporated herein by reference.

FIELD OF THE INVENTION

This invention relates to an air conditioning system and an accumulator thereof. In particular, the invention relates to an air conditioning system having a compressor and a liquid pump, more particularly, the invention relates to an air conditioning system, using a two phase refrigerant, and an accumulator thereof. Furthermore, the invention relates to an air conditioning system including a compressor, which is able to compress the two phase refrigerant, and an accumulator.

BACKGROUND

Recently, needs for conducting cooling operation even in wintertime arises for cooling rooms such as a computer room in which the temperature is high through a whole year. However, when cooling operation is conducted by a normal air conditioner having only a heat pump, i.e. a compressor, under the condition that the temperature of the outdoor air is lower than the room temperature (hereinafter, referred to as low temperature cooling operation), drawbacks occurs. For example, a difference between high and low pressures of the refrigerant is not sufficiently generated, a limitation exists for lowering the rotation number of the compressor, or the operation efficiency deteriorates.

According to JP 2000-193327A (for example, FIG. 1), an air conditioning system, conducting normal cooling operation only by using a compressor and conducting the low temperature cooling operation only by using a liquid pump, is disclosed. Specifically, when conducting the normal cooling, an on-off valve of the compressor side is released and an on-off valve of the liquid pump side is closed. Consequently, the refrigerant is supplied only to the compressor side and thus the normal cooling is operated only by the compressor. On the other hand, when conducting the low temperature cooling operation, the on-off valve of the compressor side is closed and the on-off valve of the liquid pump is released. Consequently, the refrigerant is supplied only to the liquid pump side and thus the low temperature cooling operation is conducted only by the liquid pump. Generally, the power required for driving a liquid pump is approximately one tenth of that of the compressor.

In JP 2006-322617A, another type of air conditioning system is disclosed. Referring to FIG. 1 of JP 2006-322617A, the compressor is connected in series with the liquid pump. More specifically, the compressor, the outdoor heat exchanger, the outdoor expansion valve, the receiver, the liquid pump, the liquid flow connecting pipe, the indoor heat exchanger, and the indoor expansion valve are connected in the stated order, and an electromagnetic valve connects in parallel with the liquid pump. When conducting the cooling operation by the compressor, the electromagnetic valve is released and the refrigerant is not supplied to the liquid pump. In case that natural circulating operation is conducted when the temperature of the outdoor air is low, the electromagnetic valve is closed and the refrigerant is supplied to the liquid pump.

Further, another type of air conditioning system is disclosed in JP 2006-322617A. Referring to FIG. 4, the compressor is connected with the gas refrigerant side of the gas-liquid two phase receiver and the liquid pump is connected with the liquid refrigerant of the receiver, thus connecting the compressor in parallel with the liquid pump. Meanwhile, a circuit diagram of the overall system corresponding to FIG. 4 is not shown, and a circuit diagram and a control configuration used for operating the compressor and the liquid pump simultaneously are not disclosed in JP 2006-322617A.

In JP 2002-106986A, another type of air conditioning system, which selects the operating mode according to the temperature of the outdoor air during cooling operation, is disclosed. The cooling operation is conducted by operating one of the compressor and the liquid pump or operating the compressor and the liquid pump alternately. Further, another air conditioning system is disclosed in JP 2002-106986A, the air conditioning system includes a valve opening control means and a liquid pump rotation number controlling means for increasing the refrigerant flow circulated during the operation of the liquid pump.

Further, in association with detecting the liquid surface of the refrigerant in the accumulator, another type of air conditioning system is disclosed in JP H1-107071A. The air condition system includes an inlet pipe for supplying the refrigerant into the accumulator and further includes an outlet pipe and a bypass pipe. One end of the outlet pipe inserts into the accumulator and opens above the refrigerant liquid surface and the other end connects with a suction line of the compressor. One end of the bypass pipe opens on an inner wall surface of the accumulator and the other end thereof connects with the suction line of the compressor. A first heater and a temperature sensor are installed at the inlet pipe, and a second heater and a temperature sensor are installed at the bypass line. The air conditioning system estimates the level of the refrigerant liquid surface based on the first and second heater control and the detection results of the first and second temperature sensors.

According to JP H4-222366A, JP H8-49930A, and JP H8-296908A, another type of air conditioning system is disclosed. The air conditioning system estimates a level of the refrigerant liquid surface in the accumulator by using a sensor, such as an optical sensor, installed in the accumulator.

The air conditioning system disclosed in JP2000-193327A is configured so that the compressor, which mainly operates the cooling, is deactivated and the cooling operation is conducted only by the liquid pump during the low temperature cooling operation, thus improving cooling efficiency. On the other hand, when conducting the normal cooling operation, the liquid pump is not used. Therefore, the air conditioning system disclosed in JP2000-193327A has a drawback that value=function/cost is low.

The air conditioning system shown in FIG. 1 of JP 2006-322617A has a similar drawback as JP 2000-193327A. As described above, the overall circuit diagram, corresponding to the air conditioning system in which the compressor is connected in parallel with the liquid pump, is not disclosed in JP 2006-322617A. Further, the circuit diagram and the control configuration of the air conditioning system, operating the compressor and the liquid pump simultaneously, are not disclosed.

The air conditioning system disclosed in JP 2002-106986A has a similar drawback as JP 2000-193327A. Further, according to JP 2002-106986A, the air conditioning system increases the flow of the refrigerant circulating in the system at the time of the liquid pump operation. However, the liquid pump is operated without taking the degree of superheat and dryness of the refrigerant into account. Thus, limitation exists on the efficiency improvement.

The refrigerant liquid surface detection is configured redundantly in the air conditioning systems disclosed in JP H1-107071A, JP H4-222366A, JP H8-49930A, and JP H8-296908A. Specifically, according to JP H1-107071A, the bypass pipe is newly provided to the air conditioning system in addition to the inlet pipe and the outlet pipe of the accumulator. An optical liquid surface detection sensor is provided at the accumulator of the air conditioning systems in JP H4-222366A, JP H8-49930A, and JP H8-296908A.

A need exists for an air conditioning system and an accumulator which are not susceptible to the drawback mentioned above.

Further, a need exists for an air conditioning system using the two phase refrigerant, which promptly detects a liquid surface of the refrigerant in an accumulator with a simple configuration and contributes to improvement of an operation efficiency during the low temperature cooling operation.

SUMMARY OF THE INVENTION

An aspect of the present invention provides an air conditioning system which has an outdoor heat exchanger and an indoor heat exchanger between which a refrigerant circulates to effect a heat exchange between the refrigerant and outdoor air at the outdoor heat-exchanger and to effect another heat exchange between the refrigerant and indoor air at the indoor heat exchanger and which includes a compressor sucking the refrigerant to compress and discharging resultant refrigerant, a liquid pump sucking the refrigerant to discharge, an expansion valve expanding the refrigerant, and an accumulator serving for gas-liquid separation of the refrigerant and accumulating the refrigerant in gas-phase, wherein when the compressor is brought into operation for indoor air cooling, the compressor, the outdoor heat exchanger, the expansion valve, the indoor heat exchanger, and the accumulator are connected in such an order to circulate the refrigerant therethrough, wherein suction lines of the respective compressor and liquid pump are in parallel to suck the refrigerant from the accumulator, and wherein when the compressor and the liquid pump are concurrently operated for indoor air cooling, a discharge line of the liquid pump is connected to the outdoor heat exchanger for discharging the refrigerant therefore.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
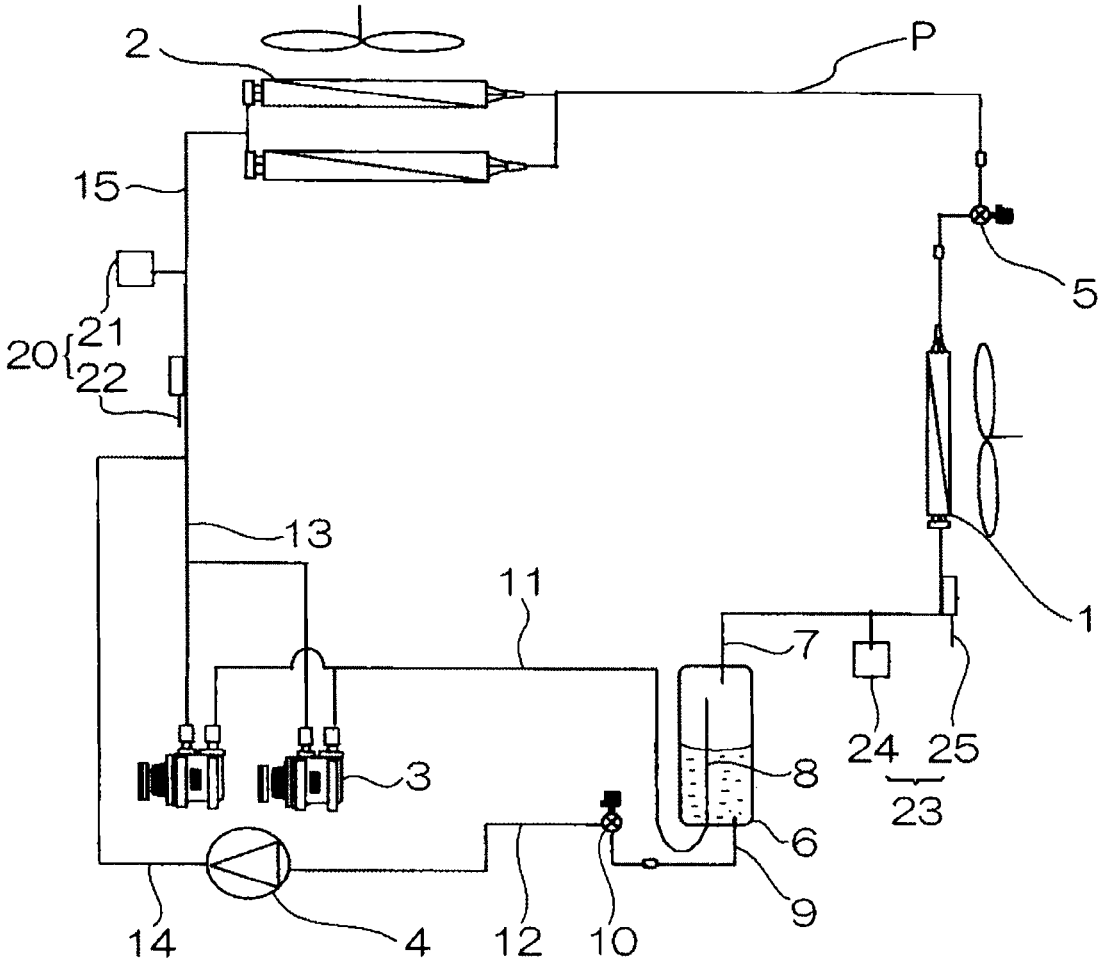
FIG. 1 is a circuit diagram of an air conditioning system according to a first embodiment of the invention.

In an air conditioning system according to embodiments, a compressor and a liquid pump are simultaneously operated at least in a predetermined mode. For example, when the low temperature cooling operation is conducted, in particular, when the operation is not properly conducted only by the liquid pump, the compressor and the liquid pump are simultaneously operated.

According to the embodiment, an air conditioning system includes a bypass circuit for switching the section, to which a discharge line of a liquid pump connects, from an outdoor heat exchanger side to an indoor heat exchanger side when the air conditioning system is operated only by the liquid pump. The bypass pipe enables the liquid pump, which requires smaller driving power in comparison with the compressor, to conduct the low temperature cooling operation, thus improving operation efficiency.

In the embodiment, a first detecting means includes a high-pressure sensor and a discharge temperature sensor. The high-pressure sensor detects the pressure of the refrigerant discharged from the compressor, and the discharge temperature sensor detects the temperature of the refrigerant (discharge temperature). The saturation temperature is calculated from the detected value of the high-pressure sensor, and the flow of the liquid pump is controlled based on a difference between the saturation temperature and the discharge temperature.

In the embodiment, the opening of a flow control valve is adjusted so that the refrigerant discharged from the compressor becomes equal to or approximates the saturation temperature. Thus, the refrigerant discharged from the compressor is efficiently condensed and liquefied in the outdoor heat exchanger during the cooling operation.

In the embodiment, the liquid pump is controlled so that the discharged pressure of the liquid pump becomes equal to or approximates the discharged pressure of the compressor. The control prevents back-flow or pulsation of the refrigerant. An axial pump is used as the liquid pump and the discharge pressure of the liquid pump is adjusted by controlling the rotation number.

According to the embodiment, the air conditioning system includes a second detecting means and an expansion valve which connects with the circuit between the outdoor heat exchanger and the indoor heat exchanger. The second detecting means detects the state quantity of the refrigerant suctioned into the compressor, and the opening of the expansion valve is adjusted based on the detection result of the second detecting means. The adjustment allows the expansion valve to adjust the degree of superheat or the degree of dryness of the two phase flow refrigerant evaporated in the indoor heat exchanger during the cooling. The second detecting means includes a low-pressure sensor and a heat exchanger outlet temperature sensor. The low-pressure sensor detects a pressure of the refrigerant suctioned into the compressor, and the heat exchanger outlet temperature sensor detects the temperature of the refrigerant (suction temperature). The saturation temperature is calculated from the detected value of the high-pressure sensor, and the opening of the expansion valve is controlled based on a difference between the saturation temperature and the heat exchanger outlet temperature.

In the embodiment, when the compressor and the liquid pump are simultaneously operated, the opening of the expansion valve is adjusted so as to be larger, compared to when only the compressor is operated. In this mode, the expansion valve may be adjusted so that the degree of superheat of the indoor heat exchanger is approximately 0 degree.

In the embodiment, the compressor is able to compress the liquid refrigerant as well as the gas refrigerant. When the refrigerant is excessively compressed, the compressor releases the refrigerant. This type of compressor may be used in air conditioning systems in which the compressor and the liquid pump connect in parallel with the accumulator, and the liquefied refrigerant may be suctioned into the compressor or a predefined or greater amount of the refrigerant may be suctioned into the compressor. Further, this type of compressor may be used in air conditioning systems in which a liquid surface detection hole is provided at an outlet pipe of an accumulator, connecting with a suction line of the compressor. In particular, the compressor may be used in the air conditioning system in which the liquefied refrigerant is introduced into the suction line of the compressor via the liquid surface detection hole and the outlet pipe with which the liquid surface detection hole communicates, depending on the level of the refrigerant liquid surface in the accumulator.

First Embodiment

Hereinafter, a first embodiment will be described with reference to drawings. FIG. 1 is a circuit diagram of an air conditioning system according to the first embodiment.

Referring to FIG. 1, the air conditioning system according to the first embodiment circulates a refrigerant between an indoor heat exchanger 1 and an outdoor heat exchanger 2. The indoor heat exchanger 1 conducts heat exchange between the refrigerant and the indoor air, and the outdoor heat exchanger 2 conducts heat exchange between the refrigerant and the outdoor air. The air conditioning system includes a compressor 3, a liquid pump 4 discharging the suctioned refrigerant, an expansion valve 5 expanding the refrigerant, and an accumulator 6. The compressor 3 compresses the suctioned refrigerant to discharge, and the accumulator 6 separates the refrigerant into gas and liquid and accumulates the refrigerant.

At least when the cooling is conducted, the compressor 3, the outdoor heat exchanger 2 serving as a condenser, the expansion valve 5, the indoor heat exchanger 1 serving as an evaporator, and the accumulator 6 are connected by refrigerant pipes P so that the refrigerant circulates through the elements in the stated order. A suction line 11 of the compressor 3 and a suction line 12 of the liquid pump 4 connect in parallel with the accumulator 6. At least when the compressor 3 and the liquid pump 4 are simultaneously operated during the cooling operation, a discharge line 14 of the liquid pump 4 connects with the outdoor heat exchanger 2 through a common line 15 which is also used for connecting the compressor 3 with the outdoor heat exchanger 2.

The accumulator 6 includes an inlet pipe 7, from which the refrigerant enters, and the inlet pipe 7 connects with the indoor heat exchanger 1. The accumulator 6 further includes first and second outlet pipes 8 and 9. One end of the first outlet pipe 8 inserts into the accumulator 6 so as to open above a liquid surface of the refrigerant reserved in the accumulator 6 and the other end connects with the suction line 11 of the compressor 3. On the other hand, one end of the second outlet pipe 9 inserts into the accumulator 6 so as to open below the liquid surface of the refrigerant reserved in the accumulator 6 and the other end connects with the suction line 12 of the liquid pump 4.

The air conditioning system includes a high-pressure sensor 21 and a discharge temperature sensor 22, which serve as a first detecting means 20 for detecting the state quantity of the refrigerant discharged from the compressor 3. The high-pressure sensor 21 detects a pressure of the refrigerant discharged from the compressor 3 or the liquid pump 4 and the discharge temperature sensor 22 detects the temperature of the refrigerant (discharge temperature). The air conditioning system further includes a low-pressure sensor 24 and a heat exchanger outlet temperature sensor 25, which serve as a second detecting means 23 for detecting the state quantity of the refrigerant suctioned into the compressor 3. The high-pressure sensor 24 detects a pressure of the refrigerant suctioned into the compressor 3, and the heat exchanger outlet temperature sensor 25 detects the temperature of the refrigerant suctioned into the compressor 3 (suction temperature).

Further, a flow control valve 10 connects in series with the circuit between the accumulator 6 and the liquid pump 4 for controlling the refrigerant flow discharged from the liquid pump 4. The flow control valve 10 controls the refrigerant flow based on a difference between a saturation temperature calculated from the detection result of the high-pressure sensor 21 and a discharge temperature detected by the discharge temperature sensor 22, thus adjusting the degree of superheat of the two phase refrigerant flow which is condensed in the outdoor heat exchanger 2 during the cooling operation.

The opening of the expansion valve 5 is controlled based on a difference between a saturation temperature calculated from detection result of the low-pressure sensor 24 and an outlet temperature of the indoor heat exchanger 1 detected by the heat exchanger outlet temperature sensor 25, thus adjusting the degree of dryness of the two phase refrigerant flow which is evaporated during the cooling operation.

Each control means of the flow control valve 10 and the expansion valve 5 is made of a central control means, a control valve, and the like. The central control means receives detection signals output from each sensor 21, 22, 23, 24 and outputs predetermined control signals based on the detection signals. The control valves are respectively attached to the flow control valve 10 and the expansion valve 5 to adjust the opening based on the control signals.

[Operating Only the Compressor During the Normal Cooling]

The operation of the air conditioning system according to the foregoing first embodiment will be described with reference to FIG. 1. Firstly, a case that the cooling operation is conducted only by the compressor 3 will be described. The refrigerant is separated into a gas refrigerant and a liquid refrigerant by the accumulator 6. Generally, the gas refrigerant containing 5 to 10 degrees of superheat is suctioned into the compressor 3 through the first outlet pipe 8 and the suction line 11. The gas refrigerant is adiabatically compressed in the compressor 3 (isentropic process and the like) and becomes a high temperature, high-pressure gas refrigerant. Then, the gas refrigerant is condensed in the outdoor heat exchanger 2 to be liquefied. The liquid refrigerant is depressurized by the expansion valve 5 disposed at the inlet side of the indoor heat exchanger 1 to become a two phase (the degree of dryness is approximately 0.2 degrees), low temperature refrigerant. The refrigerant is heated in the indoor heat exchanger 1 to evaporate, thereby lowering the room temperature. The two phase (the degree of dryness is approximately 0.2 degrees), low temperature refrigerant is gasified in the above-mentioned heating process, obtaining 5 to 10 degrees of superheat. Meanwhile, the degree of superheat in the foregoing description is obtained by adjusting the opening of the expansion valve 5. The gasified refrigerant containing the 5 to 10 degrees of superheat returns the accumulator 6 to be separated into the gas and the liquid.

[Operating the Compressor and the Liquid Pump Simultaneously During the Low Temperature Cooling Operation]

Next, the operation of the air conditioning system, in which the compressor 3 and the liquid pump 4 are simultaneously operated during the low temperature cooling operation, will be described. The following controls are conducted in this mode.

(1) Firstly, the rotation number of the liquid pump 4 is adjusted so that the discharge pressure of the compressor 3 becomes equal to that of the liquid pump 4.

(2) The flow of the liquid pump 4 is controlled by adjusting the opening of the flow control valve 10 so that the discharge temperature of the refrigerant, discharged from the compressor 3 and the liquid pump 4 to be supplied to the outdoor heat exchanger 2, becomes equal to the saturated temperature of the gas. In other words, the flow of the liquid pump 4 is controlled so that the degree of superheat becomes smaller.

(3) The opening of the expansion valve 5 is adjusted so as to be larger, compared to when the air conditioning system is operated only by the compressor 3. Specifically, the opening of the expansion valve 5 is adjusted so that the degree of superheat of the refrigerant becomes approximately 0 degree or the degree of dryness becomes 0.9 to 0.95 at the outlet of the indoor heat exchanger.

The operation of the air conditioning system in this mode will be described. The compressor 3 suctions the gas refrigerant in an upper portion of the accumulator 6 through the suction line 11 and discharges the gas refrigerant to the discharge line 13 after compression. At the same time, the liquid pump 4 suctions the liquid refrigerant in a lower portion of the accumulator 6 through the suction line 12 to increase the pressure. Subsequently, the liquid refrigerant is discharged to the discharge line 14 at the same level of the pressure as the compressor 3. The discharged refrigerant is a saturated gas and thus the refrigerant is efficiently condensed and liquefied in the outdoor heat exchanger 2.

The liquefied refrigerant is depressurized by the expansion valve 5 disposed at the inlet side of the indoor heat exchanger 1 to become a two phase (the degree of dryness is approximately 0.2 degrees), low temperature refrigerant. Subsequently, the refrigerant is heated in the indoor heat exchanger 1 to evaporate, thereby conducting the cooling operation. At that time, the degree of superheat becomes approximately 0 degree (the degree of dryness should be approximately 0.9 to 0.95 degrees). The refrigerant returns to the accumulator 6 to be separated into the gas and the liquid.

Figure 2A:
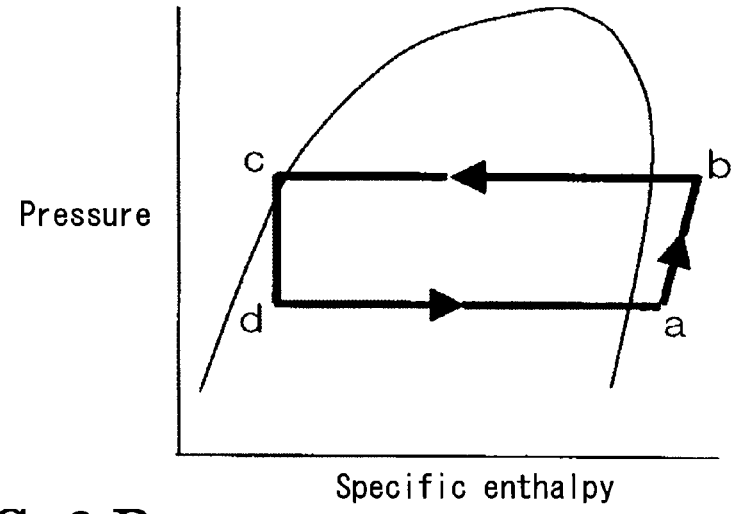
FIG. 2A is a graph showing a relation between pressure and entropy when an air conditioning system shown in FIG. 1 is operated only by a compressor.
Figure 2B:
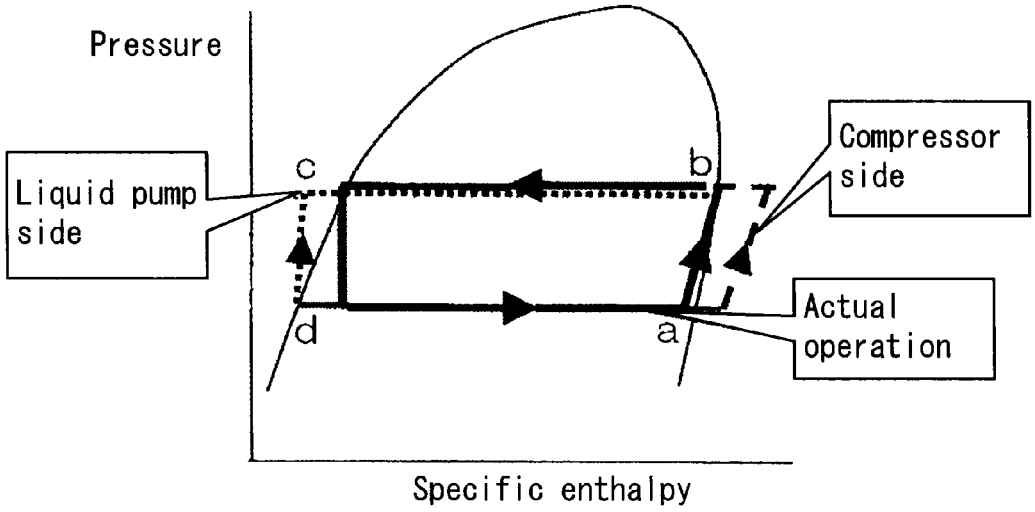
FIG. 2B is a graph showing a relation between pressure and entropy when operating the air conditioning system by the compressor and a liquid pump.

FIG. 2A is a graph showing a relation between pressure and enthalpy when the air conditioning system of FIG. 1 is operated only by the compressor, and FIG. 2B is a graph showing a relation between pressure and enthalpy when the air conditioning system of FIG. 1 is operated by the compressor and the liquid pump.

Comparing FIG. 2A with FIG. 2B, it can be seen that the following three effects are achieved by operating the compressor and the liquid pump simultaneously and the operation efficiency or coefficient of performance (COP) is improved.

(1) The liquid pump, requiring approximately one-tenth of driving power of the compressor, is used, thus reducing the power in the compression process between a and b.

(2) The refrigerant flows into the outdoor heat exchanger (condenser) as the saturated gas, thus improving the condensation efficiency in the condensation process between b and c.

(3) The refrigerant flows into the indoor heat exchanger (evaporator) containing a low degree of superheat, thus improving the evaporation efficiency in the evaporation process between d and a.

Second Embodiment

Figure 3:
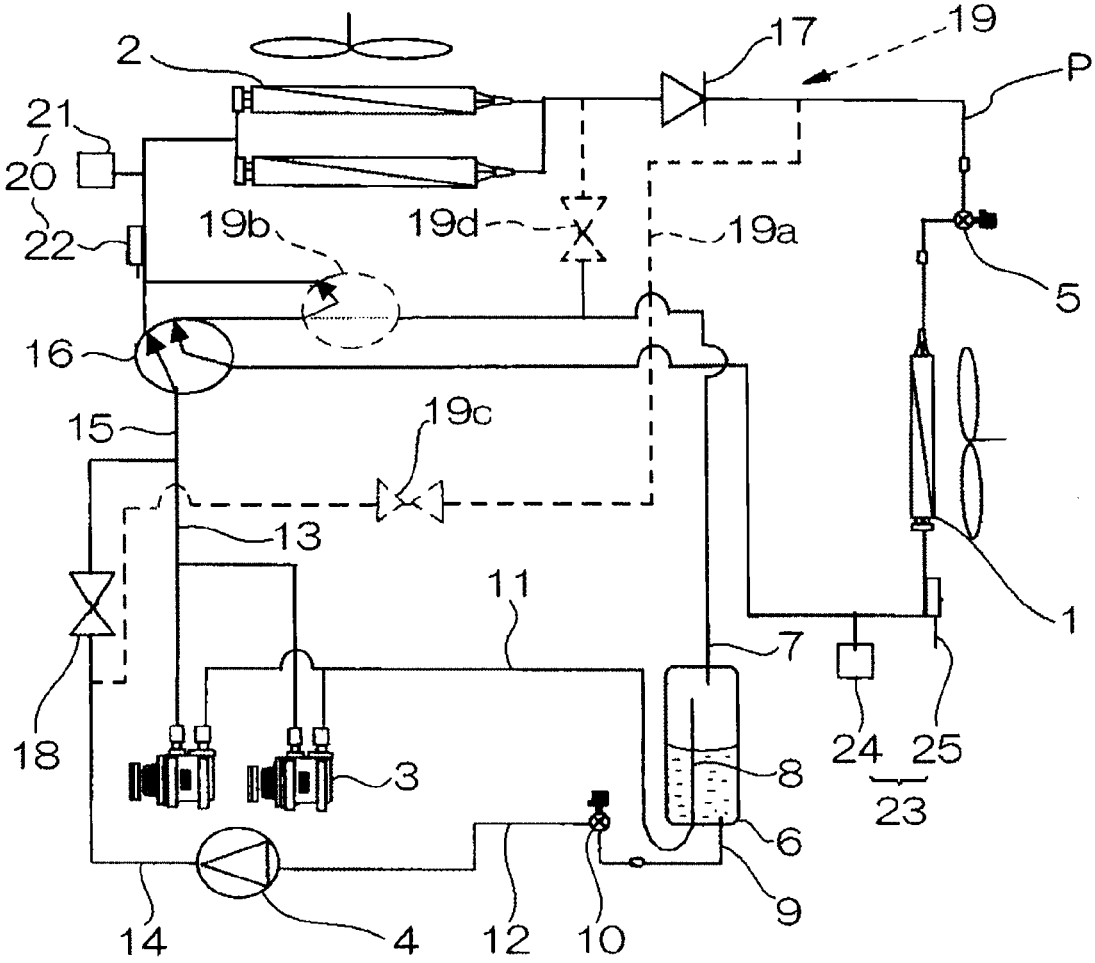
FIG. 3 is a circuit diagram of an air conditioning system according to a second embodiment of the invention.

FIG. 3 is a circuit diagram of an air conditioning system according to a second embodiment of the invention. Referring to FIG. 3, the air conditioning system according to the second embodiment includes a bypass circuit 19. The bypass circuit 19 is used for switching the section, to which the discharge line 14 of the liquid pump 4 connects, from the outdoor heat exchanger 2 to the indoor heat exchanger when the air conditioning system is operated by the liquid pump 4. Hereinafter, differences between the first and second embodiments will be mainly described. As for overlapped features and configurations, refer to the description of the first embodiment.

The air conditioning systems according to the first and second embodiments include a four way valve 16, a non-return valve 17, and an on-off valve 18. The four way valve 16 connects with the circuit between the compressor 3 and the outdoor and indoor heat exchangers 1 and 2 to change the refrigerant flow when the operation is switched between heating and cooling operations. The non-return valve 17 connects with the circuit between the outdoor and indoor heat exchangers 1 and 2. The on-off valve connects with the circuit between the discharge line 14 of the liquid pump 4 and the common line 15.

The bypass circuit 19 includes a bypass pipe 19*a*, a three way valve 19*b*, and on-off valves 19*c* and 19*d*. The bypass pipe 19*a* connects with the circuit between the liquid pump 4 and the expansion valve 5. The three way valve 19*b* switches the section, to which the indoor heat exchanger 1 connects, between the accumulator 6 and the outdoor heat exchanger 2. The on-off valve 19*c* connects with the bypass pipe 19*a*, and the on-off valve 19*d* connects the outdoor heat exchanger 2 with the accumulator 6 when the operation is conducted only by the liquid pump 4.

When conducting the cooling operation, in particular, when the low temperature cooling operation is conducted only by the liquid pump 4, the on-off valve 18 is closed and the on-off valves 19*c* and 19*d* are released. Further, the three way valve 19*b* connects the indoor heat exchanger 1 with the outdoor heat exchanger 2. In the connection, the refrigerant circulates through the liquid pump 4, the expansion valve 5, the indoor heat exchanger 1, the three way valve 19*b*, the outdoor heat exchanger 2, and the accumulator 6 in the stated order.

According to the second embodiment, the operation other than the normal cooling and heating operation, such as the low temperature cooling operation, may be conducted only by the liquid pump requiring the driving power which is smaller than that of the compressor. For example, the cooling operation may be conducted only by the liquid pump when the temperature of the outdoor air is less than or equal to 10 degrees. Hence, the operation efficiency may be improved during the low temperature cooling operation.

Third Embodiment

Figure 4:
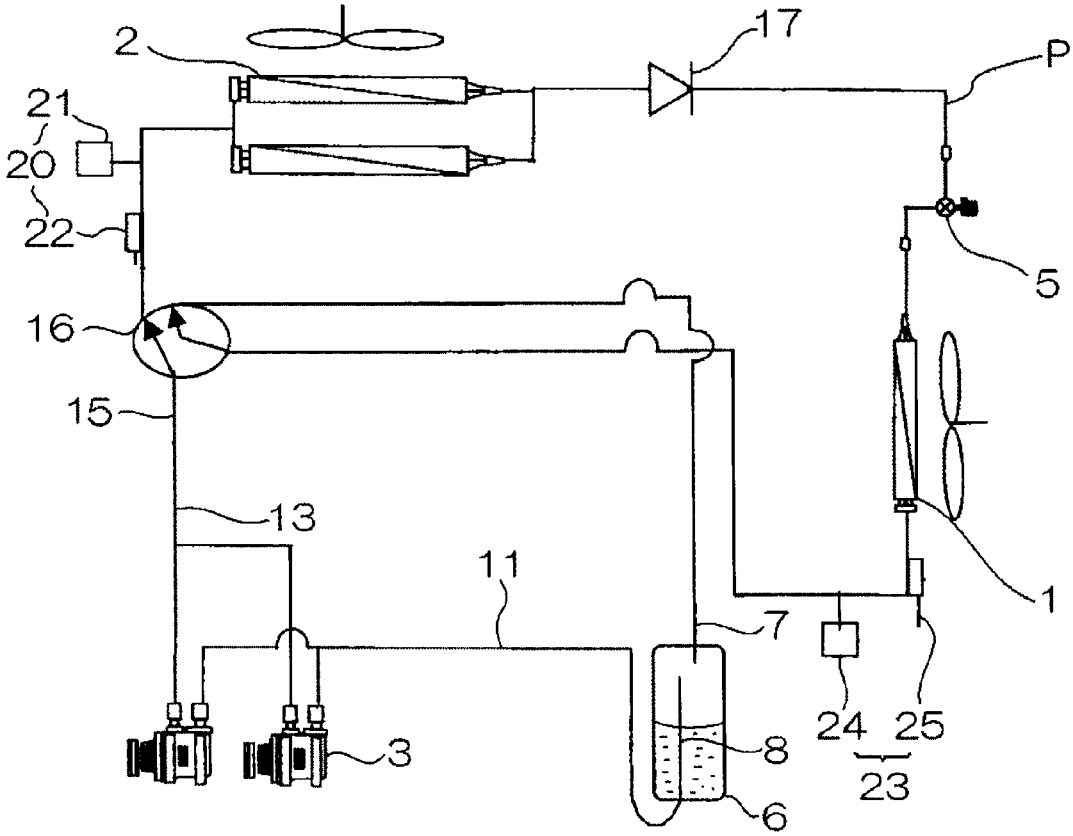
FIG. 4 is a circuit diagram of an air conditioning system according to a third embodiment of the invention.
Figure 5:
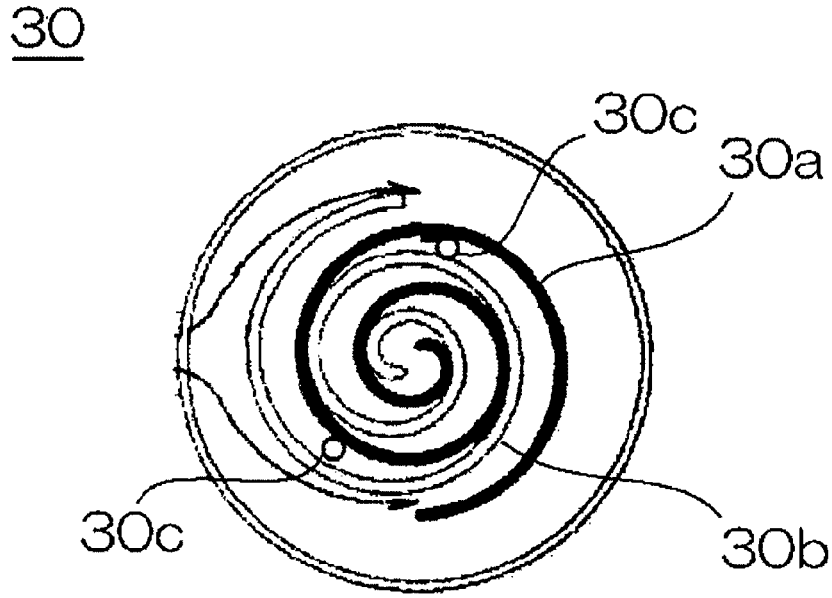
FIG. 5 is a structural diagram of a compressor having a reducing function for compressing liquid, which is used in the air conditioning system shown in FIG. 4.

FIG. 4 is a circuit diagram of an air conditioning system according to a third embodiment of the invention. FIG. 5 is a structure diagram of a compressor having a reducing function for enabling liquid compression. The compressor may be used in the air conditioning system shown in FIG. 4. Hereinafter, differences between the third embodiment and the first and second embodiments will be mainly described. As for overlapped features and configurations, refer to the description of the first embodiment.

Comparing FIG. 1 with FIG. 4, the air conditioning system according to the third embodiment shown in FIG. 4 is different from the air conditioning system according to the first embodiment shown in FIG. 1 in that the liquid pump 4, the suction line 12 and the discharge line 14 for the liquid pump 4 are not included in the air conditioning system.

Referring to FIG. 5, a liquid compressible scroll compressor 30, which may be used in the air conditioning system of FIG. 4, has a fixed wall 30*a*, a movable wall 30*b*, and a relief valve 30*c*, which is attached to a chamber surrounded by the fixed wall 30*a* and the movable wall 30*b*. When the liquid refrigerant is excessively suctioned into the compressor 30 and excessive compression may be caused due to pressure increase, the relief valve 30*c* opens automatically in response to the pressure increase for releasing the pressure to a predetermined line such as the suction line 11 or the discharge line 13.

In the air conditioning system according to the third embodiment, even if the refrigerant has a high heat transfer rate in the indoor and outdoor heat exchangers 1 and 2 (condenser and evaporator), the compressor 30 is safely driven due to the reducing function to enable the liquid compression. Thus, the high efficiency operation is achieved without using the liquid pump.

Figure 6:
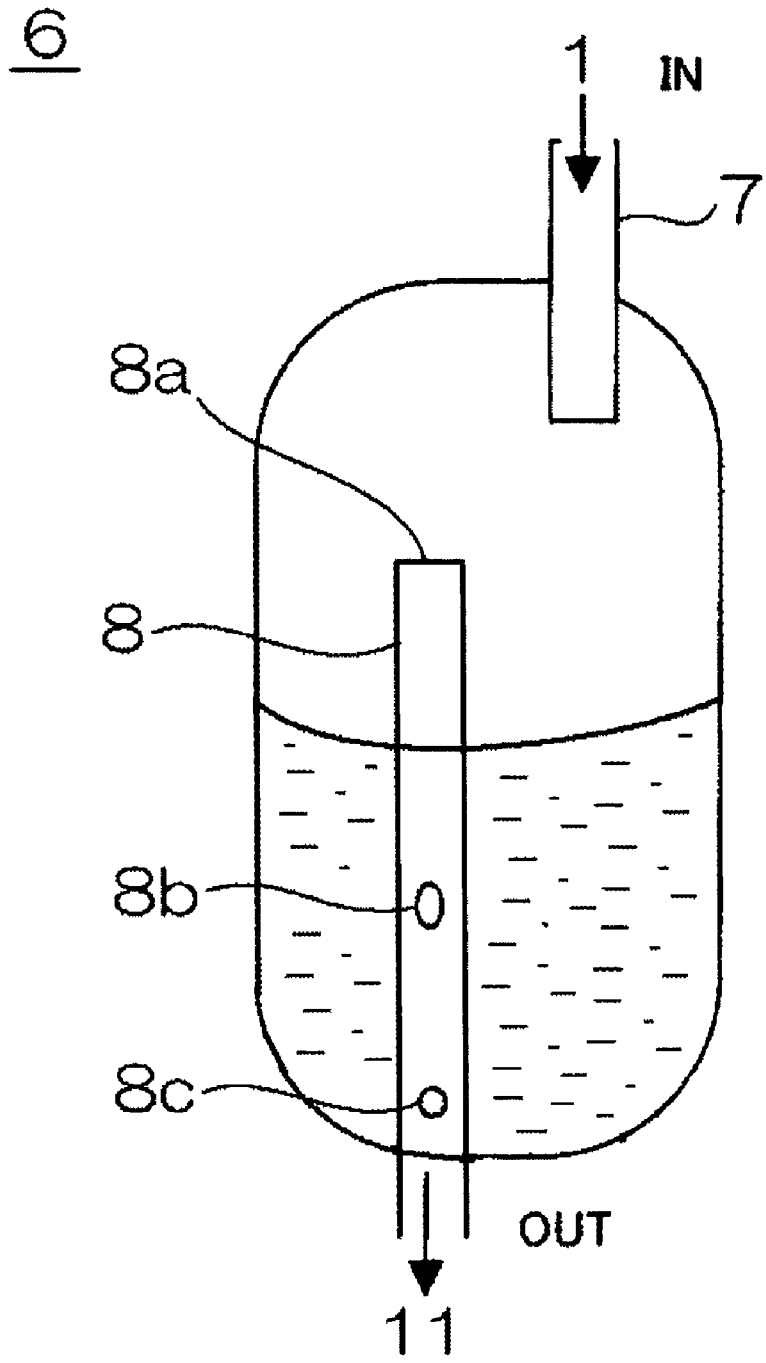
FIG. 6 is a structure diagram of an accumulator having a liquid surface detection hole according to a fourth embodiment of the invention.

In order to adjust the liquid refrigerant suctioned into the compressor 30 at a high level, an accumulator 6 shown in FIG. 6, having a liquid surface detection hole 8*b*, should be used. Details of the accumulator 6 will be described below.

Fourth Embodiment

FIG. 6 is a structural diagram of the accumulator according to a fourth embodiment, which has a liquid surface detection hole. The accumulator having the liquid surface detection hole 8*b* may be used in the air conditioning systems shown in FIG. 1, FIG. 2, and FIG. 4. In particular, the accumulator may be used in the air conditioning system shown in FIG. 4, which includes the liquid compressible compressor shown in FIG. 5.

In particular, referring to FIGS. 4 and 6, the accumulator 6 according to the fourth embodiment may be used in the air conditioning system which circulates the refrigerant between the foregoing indoor and outdoor heat exchangers 1 and 2 by using the compressor shown in FIG. 5, which has the reducing function. The accumulator 6 connects with the suction line 11 of the compressor between the indoor heat exchanger 1 and the outdoor heat exchanger 2 to separate the refrigerant into the gas and the liquid or accumulate the refrigerant.

The accumulator 6 includes the inlet pipe 7, from which the refrigerant enters, and the inlet pipe 7 connects with the indoor heat exchanger 1. The accumulator 6 further includes the first outlet pipe 8 having an opening 8*a*. One end of the first outlet pipe 8 inserts into the accumulator 6 so that the opening 8*a* opens above the liquid surface of the refrigerant reserved in the accumulator 6. The other end of the first outlet pipe 8 connects with the suction line 11 of the compressor 30.

The liquid surface detection hole 8*b* is formed at a predetermined position of the first outlet pipe 8 and opens in the accumulator 6. The liquefied refrigerant flows into the liquid surface detection hole 8*b* depending on the liquid surface level of the refrigerant reserved in the accumulator 6. The predetermined position is set so that the refrigerant liquid surface flows through the liquid surface detection hole 8*b* depending on the operation state. Moreover, the position is set so that the degrees of superheat and dryness of the refrigerant are optimized. The first outlet pipe 8 further includes an oil return hole 8*c* opening below the liquid surface of the refrigerant reserved in the accumulator 6. The oil return hole 8*c* opens in a position which is lower than the liquid surface detection hole 8*b*.

Functions of the accumulator 6 according to the fourth embodiment and the air conditioning system including the accumulator 6 will be described. Referring to FIGS. 5 and 6, when the liquid surface detection hole 8*b* is positioned above the refrigerant liquid surface in the accumulator 6, the liquid refrigerant is substantially prevented from flowing into the liquid surface detection hole 8*b*.

On the other hand, when the liquid surface detection hole 8*b* is positioned below the refrigerant liquid surface in the accumulator 6, in other words, when a large amount of the refrigerant is reserved in the accumulator 6 and a small amount of the refrigerant circulates, the liquid refrigerant flows into the liquid surface detection hole 8*b* and returns to the suction line 11 through the outlet pipe 8 to be suctioned into the compressor 30 shown in FIG. 5. Thus, the two phase refrigerant flow, containing a low degree of superheat, is supplied to the outdoor heat exchanger 2 during the cooling operation, and the local heat transfer rate is improved in the condensation process. In addition, when the liquid refrigerant flows in the liquid surface detection hole 8*b* during the cooling operation and the discharge temperature sensor 22 or the heat exchanger outlet temperature sensor 25 detects the excessive reduction of the temperature of the refrigerant suctioned into the compressor 30, the opening of the expansion valve 5 is adjusted so as to be small. Then, the degree of superheat increases in the indoor heat exchanger 1, thus preventing the compressor from suctioning the liquid refrigerant excessively.

When the liquid refrigerant accumulates in the suction line 11 of the compressor 3, the refrigerant may be returned to the accumulator 6 through the liquid surface detection hole 8*b* and the first outlet pipe 8.

Figure 7:
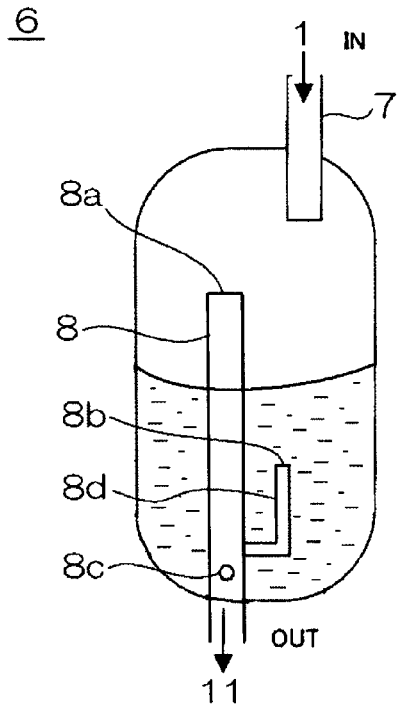
FIG. 7 is a structural diagram showing a modification of FIG. 6.

FIG. 7 is a structure diagram illustrating a modification of FIG. 6. Referring to FIG. 7, instead of a configuration in which the liquid surface detection hole 8*b* is directly formed at the first outlet pipe 8, a curved pipe 8*d* connects with the first outlet pipe 8 and an opening of the curved pipe 8*d* is used as the liquid surface detection hole 8*b*.

The air conditioning systems according to the foregoing embodiments may be applied to stand-alone type air conditioning systems or multi type air conditioning systems.

According to the embodiment described above, the compressor 3 and the liquid pump 4 are operated simultaneously or individually by using one accumulator 6 in the air conditioning system. Thus, the operation efficiency is improved during the low temperature cooling operation with a simple configuration, exhibiting smaller loss. Further, the liquid refrigerant is discharged in the air conditioning system. Hence, the accumulator 6 needs only one third of the capacity of a known accumulator.

In a known air conditioning system having only a compressor 3, the occurrence of the liquid pressure in the compressor 3 is prevented for protecting the compressor 3. Specifically, the refrigerant suctioned into the compressor 3, i.e. the refrigerant supplied from the indoor heat exchanger side to the compressor side, is excessively superheated to prevent the liquid compression.

Figure 8:
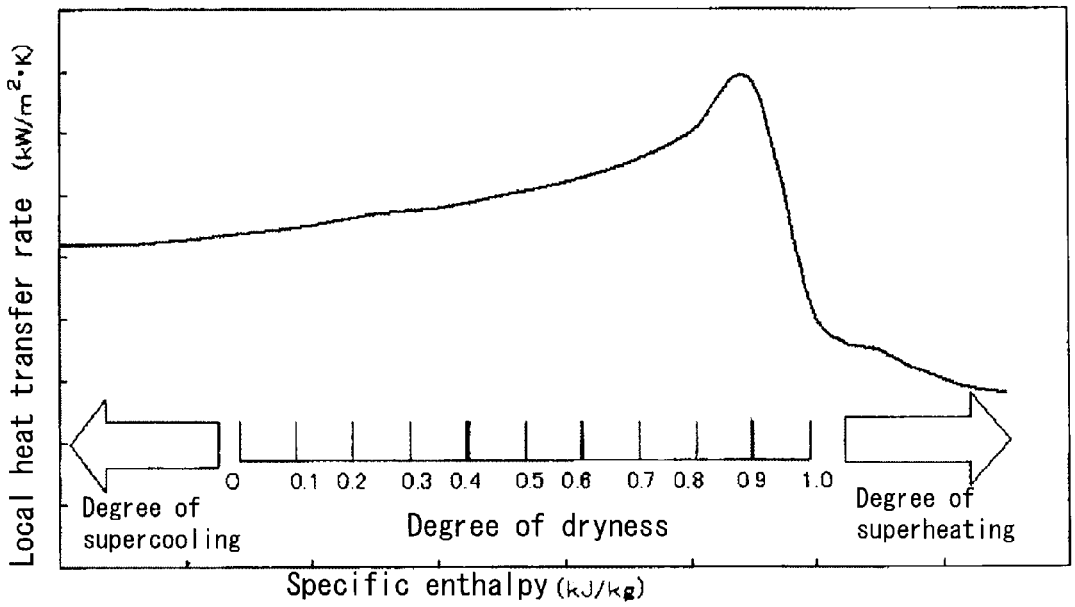
FIG. 8 is a graph showing a relation between a local heat transfer rate and degree of dryness.
Figure 9:
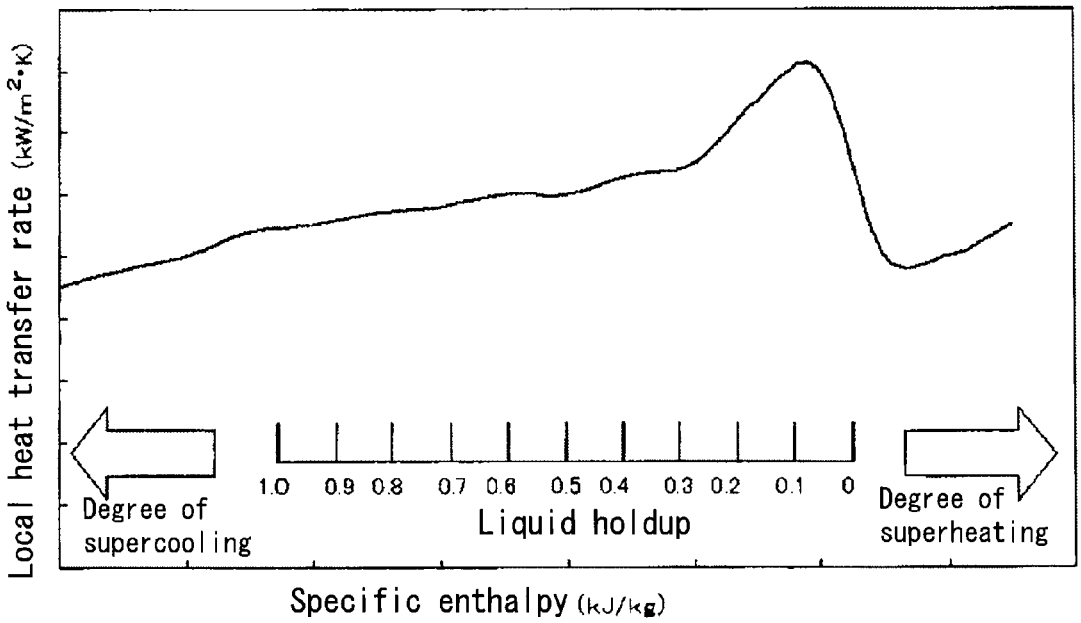
FIG. 9 is a graph showing a relation between the local heat transfer rate and liquid holdup.

On the other hand, in the air conditioning system according to the embodiment, the liquid pump 4, which is able to discharge the liquid refrigerant, connects in parallel with the compressor 3 and the liquid pump 4 and the compressor 3 are simultaneously operated. This configuration allows the compressor 3 to avoid handling the refrigerant, which contains the low degree of superheat and is easily condensed. Even if the refrigerant, which is in a desirable damp state for heat transfer efficiency (the degree of dryness is less than or equal to 1, preferably, is 0.9 to 0.95) is supplied from the indoor heat exchanger 1 (evaporator) to the compressor 3 and the liquid pump 4 during the cooling operation, the liquid refrigerant and the gas refrigerant are respectively suctioned into the liquid pump 4 and the compressor 3 through the accumulator 6. Thus, the liquid compression is prevented in the compressor 3. When the compressor 3, which is able to compress the two phase refrigerant flow, is used, the degree of superheat and the damp state of the refrigerant is more flexibly set. The reason that the operation efficiency is improved by the air conditioning system according the embodiment described above will be stated below. FIG. 8 is the graph showing the relation between the local heat transfer rate and the degree of dryness. FIG. 9 is the graph showing the relation between the local heat transfer rate and the liquid holdup.

Firstly, the heat transfer rate, i.e. an average heat transfer rate, is improved in the evaporation process (in the indoor heat exchanger 1 during the cooling operation). In the normal evaporation process, when the compressor 3 suctions the liquid refrigerant, damage may occur due to liquid compression in the compressor 3. In order to prevent the damage, the expansion valve 5 is adjusted so that the degree of superheat is set to approximately 5 to 10 degrees. However, referring to the graph showing the relation between the local heat transfer rate and the degree of dryness in FIG. 8, the local heat transfer rate (kW/m2·K) of the evaporator, i.e. the indoor heat exchanger 1 during the cooling operation, varies depending on the degree of superheat or the degree of dryness of the two phase refrigerant flow. Specifically, when the degree of dryness approximates 1, the local heat transfer rate rapidly lowers. Further, when the refrigerant contains the superheat, the local heat transfer rate further lowers. Namely, in order to improve the heat transfer rate in the evaporator (the indoor heat exchanger 1), the air conditioning system should be operated in the condition that the degree of dryness of the refrigerant is less than or equal to 0.1, in particular, 0.9 to 0.95. In the air conditioning system according to the embodiments, the refrigerant in the damp state (the degree of dryness is less than or equal to 1) is supplied to the compressor 3 and the liquid pump 4. Furthermore, the refrigerant in the damp state may be compressed by the compressor 3 which is able to compress the two phase refrigerant.

Secondly, the heat transfer rate, i.e. an average heat transfer rate, is improved in the evaporation process (in the indoor heat exchanger 1 during the cooling operation). Referring to the graph showing the relation between the local heat transfer rate and the liquid holdup in FIG. 9, as in the evaporation process, when the refrigerant contains a certain degree of superheat, the local heat transfer rate lowers. According to the embodiment, the refrigerant containing a comparatively small degree of superheat, which is easily condensed or saturated, is supplied to the condenser (the indoor heat exchanger 1 during the cooling operation) by using the liquid pump 4. Therefore, the heat transfer rate is improved in the condenser.

Thirdly, the power for driving the compressor 3 is reduced. Normally, in order to obtain the same amount of the pressure increase, the liquid pump 4 requires the power which is approximately one tenth of that of the compressor 3. Thus, comparing the use of the compressor 3 with the use of both the compressor 3 and the liquid pump 4, or with the use of the liquid pump 4, the efficiency is improved when the liquid pump 4 is used or when the compressor 3 and the liquid pump 4 are used.

According to the embodiment, when the liquid pump 4 is operated during the low temperature cooling operation, the flow of the liquid pump 4 is controlled based on the state quantity of the circulating refrigerant. Consequently, the temperature of the refrigerant, discharged from the liquid pump 4 or the compressor 3 and the liquid pump 4 to be supplied to the outdoor heat exchanger 2 (condenser), becomes equal to or approximates the saturated gas temperature. Thus, the condensation efficiency is improved and the operation efficiency is improved during the low temperature cooling operation. Further, since the existing detecting means, such as the high-pressure sensor 21 attached at the discharge line 13 of the compressor 3, may be utilized. Therefore, the foregoing effects are achieved with a simple configuration.

According to the embodiment, the compressor 3 having the relief valve mechanism for releasing the pressure during the compression and compressing the liquid is used, and the accumulator 6 controls the supply amount of the liquid refrigerant to the compressor 3. This configuration may improve the operation efficiency during the low temperature cooling operation without using the liquid pump 4. The accumulator 6 accumulates the excessive liquid refrigerant and supplies the predetermined amount of the liquid refrigerant to the suction line 11 of the compressor 3 through the liquid surface detection hole 8*b*. Hence, the proper amount of the liquid refrigerant is supplied to the compressor 3, and the compressor 3 discharges the liquid refrigerant in the damp state, which is desirable for the heat transfer rate. As just described, in the air conditioning system according to the embodiment, the liquid refrigerant is discharged, thus reducing the capacity of the accumulator 6 to one third of the know accumulator.

According to the embodiment, the liquid surface detection hole 8*b* is formed in the outlet pipe 8 of the accumulator 6, and the pressure or the temperature of the refrigerant, circulated, suctioned, or discharged, varies between when the liquid surface detection hole 8*b* is positioned above the refrigerant liquid surface in the accumulator 6 and when the liquid surface detection hole 8*b* is positioned below the refrigerant liquid surface. Such variations are easily detected by the existing detecting means such as the high-pressure sensor 21, the discharge temperature sensor 22, the low-pressure sensor 24 or the heat exchanger outlet temperature sensor 25. Thus, the accumulator 6 is configured so as to detect the refrigerant liquid surface level in the accumulator 6 with the simple configuration utilizing the existing components. Further, the flow or the rotation number of the liquid pump 4, the rotation number of the compressor 3, and the opening of the expansion valve 5 are controlled based on the detection result of the liquid surface. Hence, the refrigerant in the damp state, which is desirable for the heat transfer rate, is generated and the operation efficiency is improved during the low temperature cooling operation.

The principles, of the preferred embodiments and mode of operation of the present invention have been described in the foregoing specification. However, the invention, which is intended to be protected, is not to be construed as limited to the particular embodiment disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents that fall within the spirit and scope of the present invention as defined in the claims, be embraced thereby.

The invention claimed is:

1. An air conditioning system having an outdoor heat exchanger and an indoor heat exchanger between which a refrigerant circulates to effect a heat exchange between the refrigerant and outdoor air at the outdoor heat-exchanger and to effect another heat exchange between the refrigerant and indoor air at the indoor heat exchanger, the air conditioning system comprising:

a compressor that sucks the refrigerant to compress and that discharges the resulting refrigerant;

a liquid pump that sucks the refrigerant to discharge;

an expansion valve that expands the refrigerant;

an accumulator that serves for gas-liquid separation of the refrigerant and that accumulates the refrigerant in liquid phase, wherein when the compressor is brought into operation for indoor air cooling, the compressor, the outdoor heat exchanger, the expansion valve, the indoor heat exchanger, and the accumulator are connected in such an order to circulate the refrigerant therethrough; and a bypass circuit used to switch a portion, to which the discharge line of the liquid pump connects, from an outdoor heat exchanger side to an indoor heat exchanger side when the operation is conducted only by the liquid pump, wherein suction lines of the respective compressor and liquid pump are in parallel to suck the refrigerant from the accumulator, and wherein when the compressor and the liquid pump are concurrently operated for indoor air cooling, a discharge line of the liquid pump is connected to the outdoor heat exchanger to discharge the refrigerant therefrom.

2. An air conditioning system according to claim 1, wherein the compressor and the liquid pump are simultaneously operated in a given mode.

3. An air conditioning system according to claim 1, wherein the accumulator comprises:

an outlet pipe whose one end inserts into the accumulator so as to open above a liquid surface of the refrigerant reserved in the accumulator and the other end connects with the suction line side of the compressor, wherein the outlet pipe includes a liquid surface detection hole formed in a predetermined position in the outlet pipe and opening in the accumulator, and the liquefied refrigerant flows in the liquid surface detection hole depending on a liquid surface level of the refrigerant reserved in the accumulator.

4. An air conditioning system having an outdoor heat exchanger and an indoor heat exchanger between which a refrigerant circulates to effect a heat exchange between the refrigerant and outdoor air at the outdoor heat-exchanger and to effect another heat exchange between the refrigerant and indoor air at the indoor heat exchanger, the air conditioning system comprising:

a compressor that connects with a circuit of the air conditioning system between the indoor heat exchanger and the outdoor heat exchanger, the compressor compressing and discharging the suctioned refrigerant;

a liquid pump that connects in parallel with the compressor between the indoor heat exchanger and the outdoor heat exchanger, the liquid pump discharging the suctioned refrigerant;

a first detecting unit that detects a state quantity of the refrigerant discharged from the compressor; and a flow control valve that connects with the liquid pump, the flow control valve adjusting a degree of superheat of a two phase refrigerant flow condensed in the outdoor heat exchanger during cooling operation by controlling a flow of the refrigerant discharged from the liquid pump based on a detection result of the first detecting unit.

5. An air conditioning system according to claim 4, further comprising:

a second detecting unit that detects a state quantity of the refrigerant suctioned into the compressor; and an expansion valve that connects with the circuit between the indoor heat exchanger and the outdoor heat exchanger, the expansion valve whose opening is controlled based on a detection result of the second detecting unit to adjust a degree of superheat and a degree of dryness of a two phase refrigerant flow evaporated in the indoor heat exchanger during the cooling operation.

6. An air conditioning system according to claim 5, wherein when the compressor and the liquid pump are simultaneously operated, an opening of the expansion valve is adjusted so as to be larger, compared to when the compressor is operated.

7. An air conditioning system according to claim 4, wherein the liquid pump is controlled so that a discharge pressure of the liquid pump equals or approximates a discharge pressure of the compressor.

8. An air conditioning system having an outdoor heat exchanger and an indoor heat exchanger between which a refrigerant circulates to effect a heat exchange between the refrigerant and outdoor air at the outdoor heat-exchanger and to effect another heat exchange between the refrigerant and indoor air at the indoor heat-exchanger, the air conditioning system comprising:

a compressor that connects with a circuit of the air conditioning system between an indoor heat exchanger and an outdoor heat exchanger for compressing and discharging the suctioned refrigerant, the compressor compressing gas and liquid;

a liquid pump that sucks the refrigerant to discharge and configure to operate solely or in concurrency with the compressor;

a bypass circuit used to switch a portion, to which the discharge line of the liquid pump connects, from an outdoor heat exchanger side to an indoor heat exchanger side when the operation is conducted only by the liquid pump; and an accumulator that connects with a suction line side of the compressor between the indoor heat exchanger and the outdoor heat exchanger, the accumulator separating the refrigerant into the liquid and the gas and accumulating the refrigerant, wherein the accumulator includes an outlet pipe whose one end inserts into the accumulator so as to open above a liquid surface of the refrigerant reserved in the accumulator and the other end connects with the suction line side of the compressor, wherein the outlet pipe includes a liquid surface detection hole formed in a predetermined position in the outlet pipe and opening in the accumulator, and the liquefied refrigerant flows in the liquid surface detection hole depending on a liquid surface level of the refrigerant reserved in the accumulator.

* * * * *